United States Patent [19]

Smith et al.

[11] Patent Number: 4,882,125

[45] Date of Patent: Nov. 21, 1989

[54] SULFIDATION/OXIDATION RESISTANT ALLOYS

[75] Inventors: Gaylord D. Smith; Curtis S. Tassen, both of Huntington, W. Va.

[73] Assignee: INCO Alloys International, Inc., Huntington, Va.

[21] Appl. No.: 184,771

[22] Filed: Apr. 22, 1988

[51] Int. Cl.[4] ..... C22C 19/05

[52] U.S. Cl. ..... 420/443; 420/445; 420/446; 420/447; 420/449

[58] Field of Search ..... 420/443, 445, 446, 447, 420/449; 148/410, 428

[56] References Cited

U.S. PATENT DOCUMENTS

| | | | |
|---|---|---|---|
| 3,565,611 | 2/1971 | Economy | 420/445 |
| 3,573,901 | 4/1971 | Economy | 420/445 |
| 3,574,604 | 4/1971 | Copson et al. | 420/446 |
| 3,690,873 | 7/1969 | Fontaine | 420/584 |
| 3,817,747 | 6/1974 | Schultz et al. | 420/446 |
| 3,984,239 | 10/1976 | Petersen | 420/446 |
| 4,388,125 | 6/1983 | Benn | 420/443 |

*Primary Examiner*—R. Dean

*Attorney, Agent, or Firm*—Francis J. Mulligan, Jr.; Edward A. Steen

[57] ABSTRACT

Nickel-base, high chromium alloys characterized by good sulfidation and oxidation resistance consisting essentially of about 27 to 35% chromium, about 2.5 to 5% aluminum, about 2.5 to about 6% iron, 0.5 to 2.5% columbium, up to 0.1% carbon, up to 1% each of titanium and zirconium, up to 0.05% cerium, up to 0.05% yttrium, up to 1% silicon, up to 1% manganese, balance nickel.

12 Claims, 5 Drawing Sheets

SULFIDATION/OXIDATION RESISTANT ALLOYS

FIELD OF THE INVENTION

Figure 1:
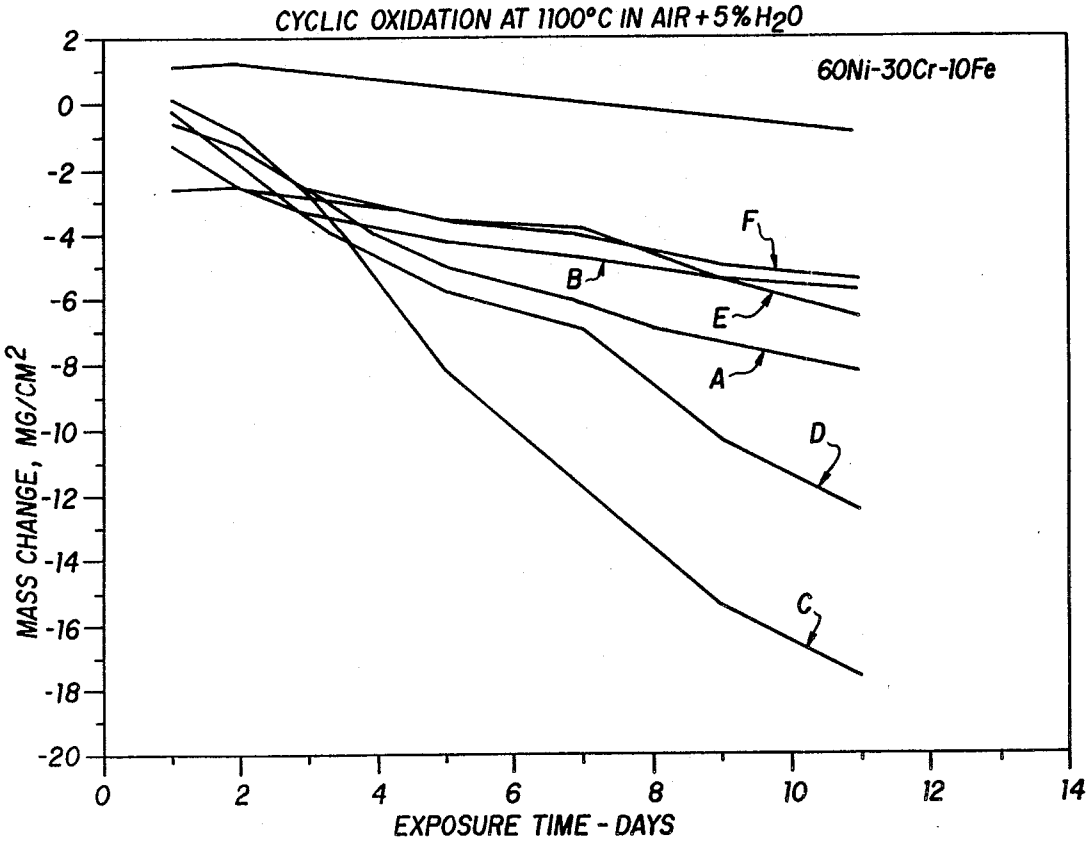

The present invention is directed to nickel-chromium alloys, and more particularly to nickel-chromium alloys which offer a high degree of resistance to sulfidation and oxidation attack at elevated temperatures together with good stress-rupture and tensile strengths and other desired properties.

INVENTION BACKGROUND

Nickel-chromium alloys are known for their capability of affording various degrees of resistance to a host of diverse corrosive environments. For this reason such alloys have been widely used in sundry applications, from superalloys in aerospace to marine environments. One particular area of utility has been in glass vitrification furnaces for nuclear wastes. The alloy that has been conventionally employed is a nominal 60Ni-30Cr-10Fe composition which is used as the electrode material submerged in the molten glass and for the pouring sout. It has also been used for the heaters mounted in the roof of the furnace and for the effluent containment hardware.

By reason of its strength and corrosion resistance in such an environment, the 60Ni-30Cr-10Fe alloy provides satisfactory service for a period of circa 2 years, sometimes less sometimes more. It normally fails by way of sulfidation and/or oxidation attack, probably both. It would thus be desirable if an alloy for such an intended purpose were capable of offering an extended service life, say 3–5 years or more. This would not only require a material of greatly improved sulfidation/oxidation resistance, but also material that possessed high stress rupture strength characteristics at such operating temperatures, and also good tensile strength, toughness and ductility, the latter being important in terms of formability operations. To attain the desired corrosion characteristics at the expense of strength and other properties would not be a desired panacea.

INVENTION SUMMARY

We have found that an alloy containing controlled and correlated percentages of nickel, chromium, aluminum, iron, carbon, columbium, etc. as further described herein provides an excellent combination of (i) sulfidation and (ii) oxidation resistance at elevated temperatures, e.g., 1800°–2000° F. (982°–1093° C.) (iii) together with good stress-rupture and creep strength at such high temperatures, plus (iv) satisfactory tensile strength, (v) toughness, (iv) ductility, etc. As an added attribute, the alloy is also resistant to carburization. In terms of a glass vitrification furnace, the subject alloy is deemed highly suitable to resist the ravages occasioned by corrosive attack above the glass phase. In this zone of the furnace the alloy material is exposed to and comes into contact with a complex corrosive vapor containing such constituents as nitrogen oxide, nitrates, carbon dioxide, carbon monoxide, mercury and splattered molten glass and glass vapors.

Apart from combatting such an aggressive environment an improved alloy must be capable of resisting stress rupture failure at the operating temperature of the said zone. This, in accordance herewith, requires an alloy which is characterized by a stress-rupture life of about 200 hours or more under a stress of 2000 psi and temperature of 1800° F. (980° C.).

INVENTION EMBODIMENTS

Generally speaking, the present invention contemplates a nickel-base, high chromium alloy which contains about 27 to 35% chromium, from about 2.5 to 5% aluminum, about 2.5 to 5.5 or 6% iron, from 0.0001 to about 00.1% carbon, from 0.5 to 2.5% columbium, up to 1% titanium, up to 1% zirconium, up to about 0.05% cerium, up to about 0.05% yttrium, up to 0.01% boron, up to 1% silicon, up to 1% manganese, the balance being essentially nickel. The term "balance" or "balance essentially" as used herein does not, unless indicated to the contrary, exclude the presence of other elements which do not adversely affect the basic characteristics of the alloy, including incidental elements used for cleansing and deoxidizing purposes. Phosphorus and sulfur should be maintained at the lowest levels consistent with good melting practice. Nitrogen is beneficially present up to about 0.04 or 0.05%.

In carrying the invention into practice it is preferred that the chromium content not exceed about 32%, this by reason that higher levels tend to cause spalling or scaling in oxidative environments and detract from stress-rupture ductility. The chromium can be extended down to say 25% but at the risk of loss in corrosion resistance, particularly in respect of the more aggressive corrosives.

Aluminum markedly improves sulfidation resistance and also resistance to oxidation. It is most preferred that it be present in amounts of at least about 2.75 or 3%. High levels detract from toughness in the aged condition. An upper level of about 3.5% or 4% is preferred. As is the case with chromium, aluminum percentages down to 2% can be employed but again at a sacrifice of corrosion resistance. Iron if present much in excess of 5.5 or 6% can introduce unnecessary problems. It is theorized that iron segregates at the grain boundaries such that carbide morphology is adversely affected and corrosion resistance is impaired. Advantageously, iron should not exceed 5%. It does lend to the use of ferrochrome; thus, there is an economic benefit. A range of 2.75 to 5% is deemed most satisfactory.

As above indicated, it is preferred that the alloys contain columbium and in this regard at least 0.5 and advantageously at least 1% should be present. It advantageously does not exceed 1.5%. Columbium contributes to oxidation resistance. However, if used to the excess, particularly in combination with the higher chromium and aluminum levels, morphological problems may ensue and rupture life and ductility can be affected. In the less aggressive environments columbium may be omitted but poorer results can be expected. Titanium and zirconium provide strengthening and zirconium adds to scale adhesion. However, titanium detracts from oxidation resistance and it is preferred that it not exceed about 0.5%, preferably 0.3%. Zirconium need not exceed 0.5%, e.g., 0.25%. It is preferred that carbon not exceed about 0.04 or 0.05%. Boron is useful as a deoxidizer and from 0.001 to 0.01% can be utilized to advantage. Cerium and yttrium, particularly the former, impart resistance to oxidation. A cerium range of about 0.005 or 0.008 to 0.15 or 0.12% is deemed quite satisfactory. Yttrium need not exceed 0.01%.

Manganese subverts oxidation resistance and it is preferred that it not exceed about 0.5%, and is preferably held to 0.2% or less. A silicon range of 0.05 to 0.5% is satisfactory.

In respect of processing procedures vacuum melting is recommended. Electroslag remelting can also be used but it is more difficult to hold nitrogen using such processing. Hot working can be conducted over the range of 1800° F. (982° C.) to 2100° F. (1150° C.). Annealing treatments should be performed within the temperature range of about 1900° F. (1038° C.) to 2200° F. (1204° C.), e.g., 1950° F. (1065° C.) to 2150° F. (1177° C.) for up to 2 hours, depending upon section size. One hour is usually sufficient. The alloy primarily is not intended to be used in the age-hardened condition. However, for applications requiring the highest stress-rupture strength levels at, say, intermediate temperatures of 1200° to 1700° or 1800° F. the instant alloy can be aged at 1300° F. (704° C.) to 1500° F. (815° C.) for up to, say, 4 hours. Conventional double ageing treatments may also be utilized. It should be noted that at the high sulfidation/oxidation temperatures contemplated, e.g., 2000° F. (1093° C.) the precipitating phase ($Ni_3Al$) formed upon age hardening would go back into solution. Thus, there would be no beneficial effect by ageing though there would be at the intermediate temperatures.

For the purpose of giving those skilled in the art a better appreciation of the invention the following illustrative data are given.

A series of 15 Kg. heats was prepared using vacuum melting, the compositions being given in Table I below. Alloys A-F, outside the invention, were hot forged at 2150° F. (1175° C.) from 4 inch (102 mm) diameter×length ingots to 0.8 inch (20.4 mm) diameter×length rod. A final anneal at 1900° F. (1040° C.) for 1 hour followed by air cooling was utilized. Oxidation pins 0.3 inch (7.65 mm) in diameter by 0.75 inch (19.1 mm) in length were machined and cleaned in acetone. The pins were exposed for 240 hours at 2020° F. (1100° C.) in air plus 5% water atmosphere using an electrically heated mullite tube furnace. Oxidation data are graphically shown in FIG. 1. Alloys A-F are deemed representative of the conventional 60Ni-30Cr-10Fe alloy with small additions of cerium, columbium and aluminum. The nominal 60Ni-30Cr-10Fe alloy normally contains small percentages of titanium, silicon, manganese and carbon. Oxidation results for standard 60Ni-30Cr-10Fe are included in Table II and FIG. 1.

Figure 2:
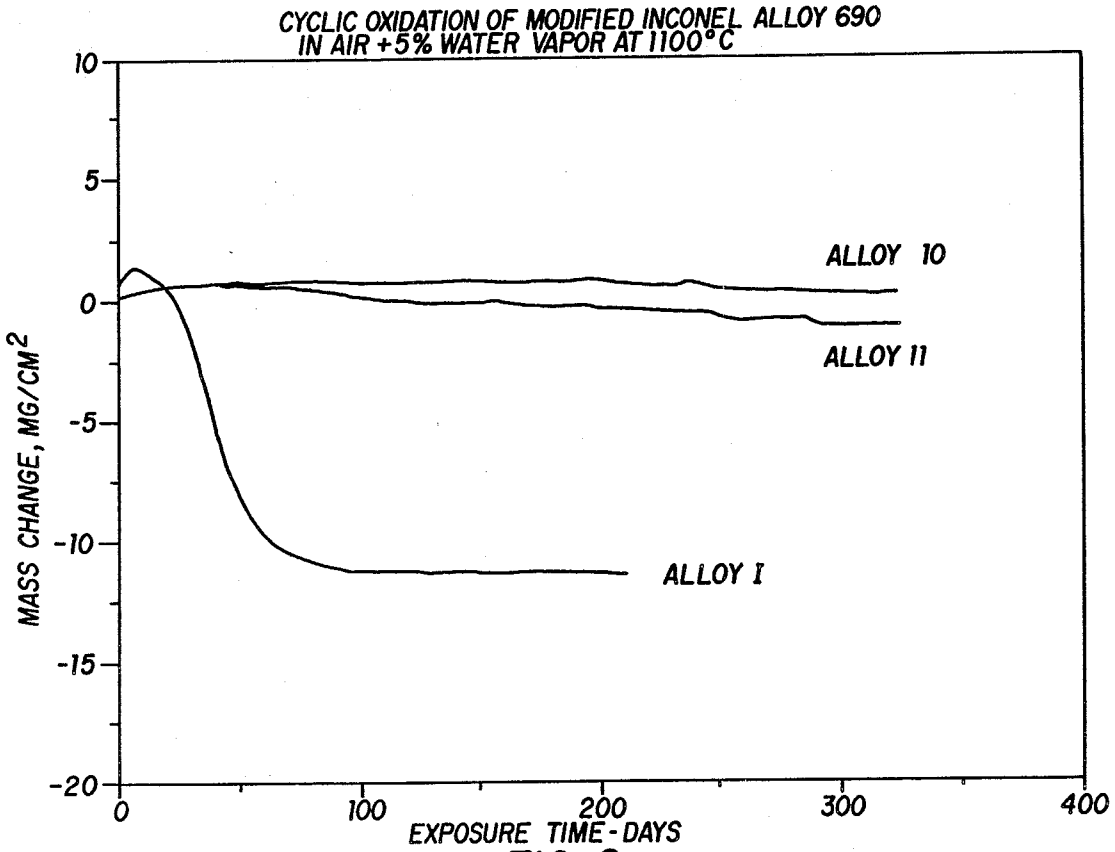
Figure 3:
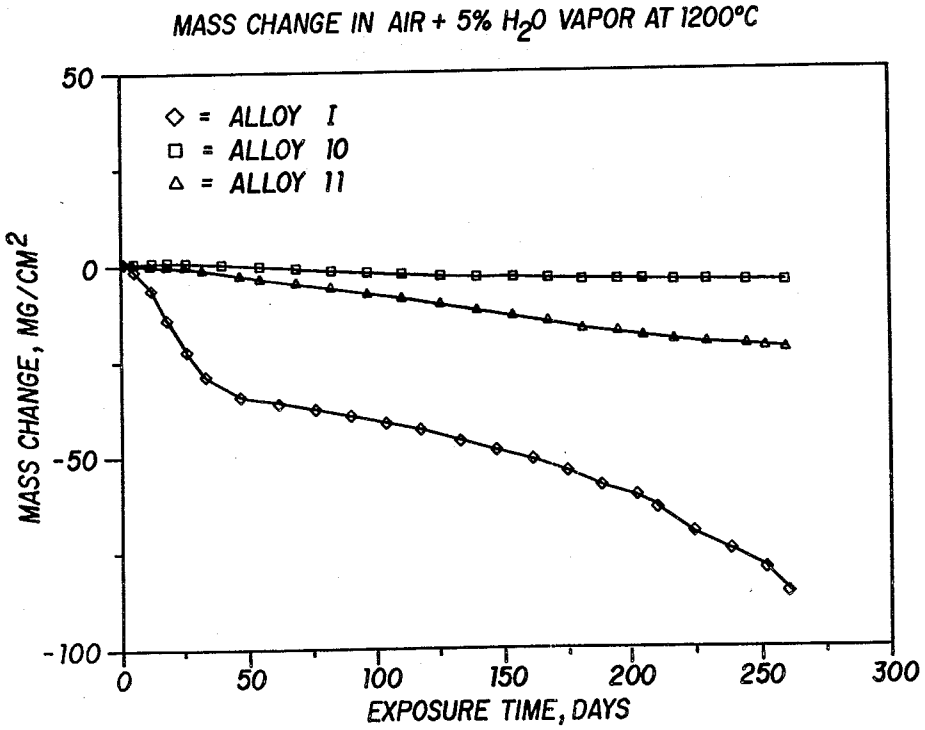
Figure 4:
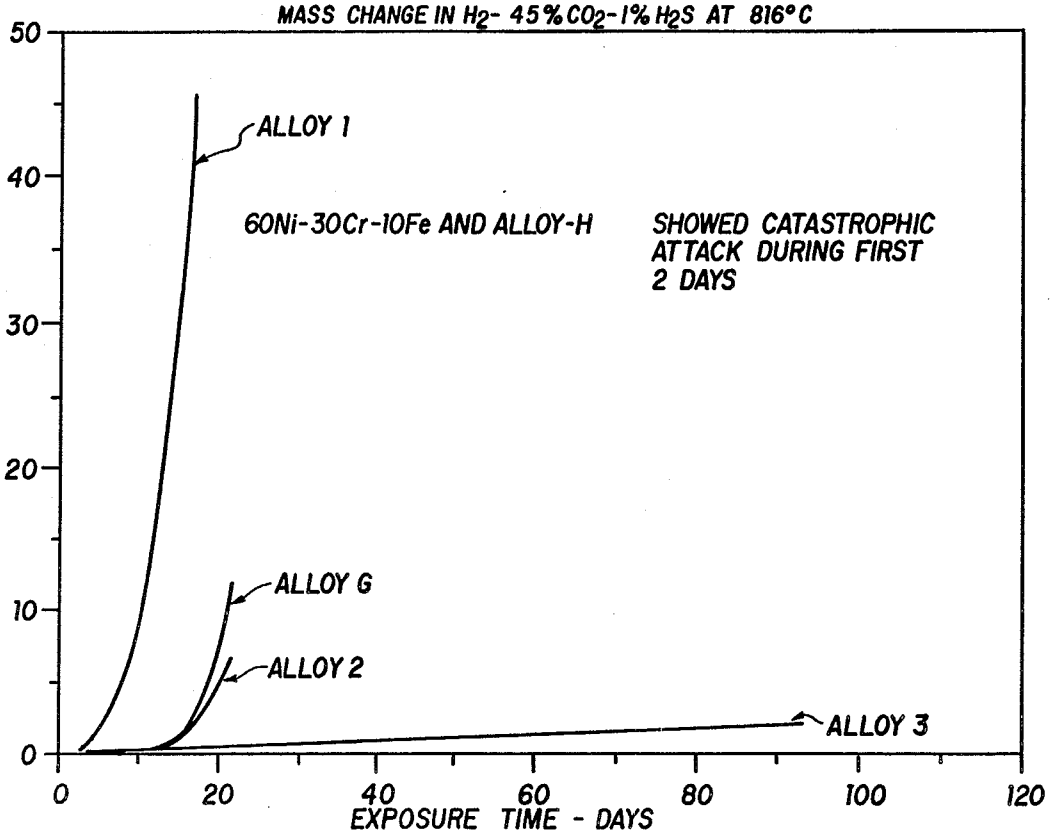
Figure 5:
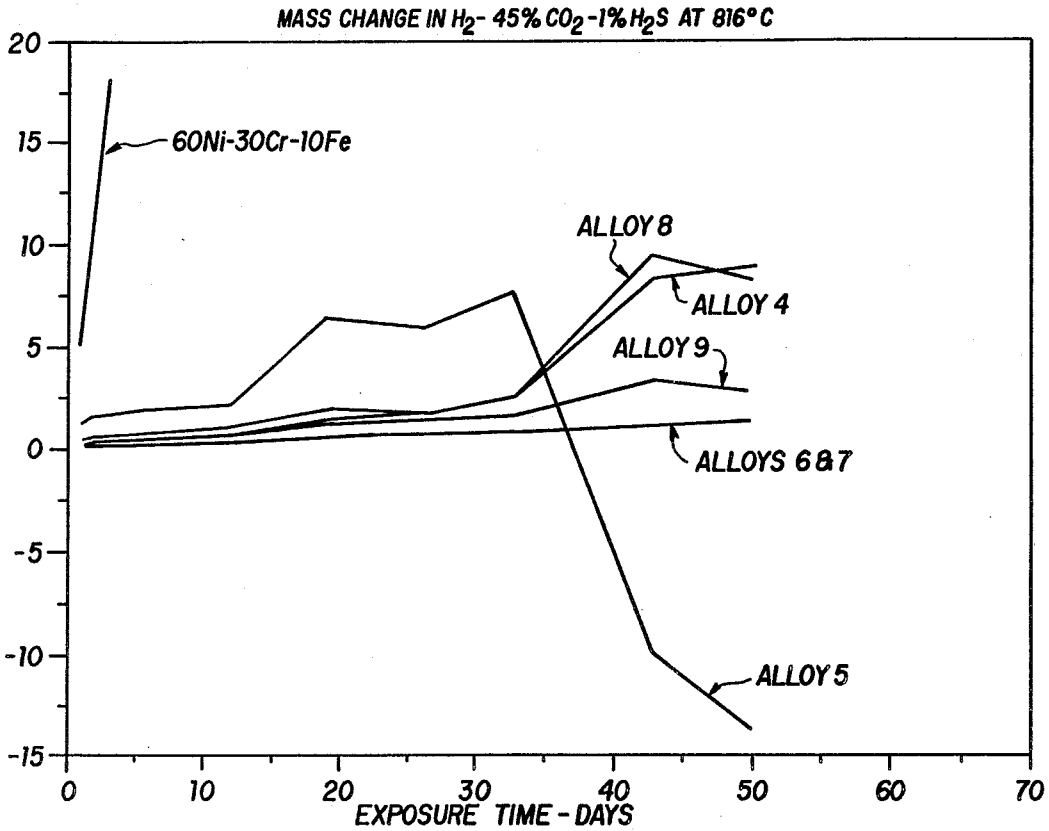

Alloys 1 to 16, G, H, and I, also set forth in Table I, were vacuum cast as above but were hot rolled to final bar size at 1120° C. (approximately 2050° F.) rather than having been initially hot forged. Sulfidation and oxidation results are reported in Table II. Also included are carburization resistance results, the test condition being given in Table II. Stress rupture properties are given in Table III with tensile properties being set forth in Table IV. FIGS. 2 and 3 also graphically depict oxidation results of Alloys I, 10 and 11. FIGS. 4 and 5 illustrate graphically the sulfidation results for Alloys 1, 2 and 6. (FIG. 4) and Alloys 4–9 (FIG. 5). The oxidation test was the cyclic type wherein specimens were charged in an electrically heated tube furnace for 24 hours. Samples were then weighed. The cycle has repeated for 42 days (unless otherwise indicated). Air plus 5% water vapor was the medium used for test. The sulfidation test consisted of metering the test medium ($H_2$+45%$CO_2$+1%$H_2S$) into an electric heater tube furnace (capped ends). Specimens were approximately 0.3 in. dia.×¾in. high and were contained in a cordierite boat. Time periods are given in Table II.

TABLE I

| Alloy | Composition Weight Percent | | | | | | | | |
|---|---|---|---|---|---|---|---|---|---|
| | C | Mn | Fe | Cr | Al | Cb | Si | Ti | Ce |
| A | 0.16 | 0.180 | 8.84 | 29.22 | 0.32 | 0.06 | 0.11 | 0.37 | 0.0005 |
| B | 0.053 | 0.160 | 8.50 | 29.93 | 0.31 | 0.02 | 0.25 | 0.37 | 0.021 |
| C | 0.051 | 0.160 | 7.59 | 30.04 | 0.33 | 0.99 | 0.28 | 0.36 | 0.0005 |
| D | 0.032 | 0.160 | 7.71 | 30.06 | 0.31 | 0.10 | 0.28 | 1.02 | 0.0005 |
| E | 0.027 | 0.160 | 7.48 | 30.05 | 0.32 | 0.99 | 0.27 | 0.40 | 0.018 |
| F | 0.039 | 0.020 | 8.54 | 30.33 | 0.30 | 0.11 | 0.26 | 0.36 | 0.012 |
| G | 0.006 | 0.010 | 7.00 | 29.49 | 2.75 | 0.57 | 0.130 | 0.02 | 0.011 |
| 1 | 0.007 | 0.010 | 5.95 | 29.89 | 2.85 | 1.07 | 0.130 | 0.02 | 0.005 |
| 2 | 0.006 | 0.010 | 5.80 | 30.01 | 3.27 | 0.54 | 0.120 | 0.01 | 0.016 |
| 3 | 0.009 | 0.010 | 4.30 | 30.02 | 3.27 | 2.04 | 0.140 | 0.02 | 0.016 |
| H | 0.009 | 0.010 | 9.04 | 29.95 | 0.41 | 0.17 | 0.140 | 0.01 | 0.001 |
| 4 | 0.002 | 0.091 | 4.45 | 31.90 | 3.11 | 1.05 | 0.370 | 0.22 | 0.004* |
| 5 | 0.007 | 0.099 | 4.53 | 34.94 | 3.20 | 1.07 | 0.380 | 0.22 | 0.005* |
| 6 | 0.006 | 0.100 | 3.81 | 30.45 | 3.99 | 1.06 | 0.380 | 0.22 | 0.004* |
| 7 | 0.006 | 0.100 | 2.79 | 30.20 | 3.98 | 2.00 | 0.370 | 0.22 | 0.004* |
| 8 | 0.007 | 0.110 | 4.63 | 30.00 | 3.08 | 1.13 | 0.380 | 0.23 | 0.037* |
| 9 | 0.006 | 0.098 | 3.75 | 30.14 | 3.05 | 2.01 | 0.380 | 0.21 | 0.044* |
| I | 0.011 | 0.018 | 8.47 | 27.19 | 2.8 | 0.10 | 0.079 | 0.007 | 0.013 |
| 10 | 0.015 | 0.014 | 5.57 | 29.42 | 3.20 | 1.04 | 0.075 | 0.02 | 0.008 |
| 11 | 0.026 | 0.014 | 5.41 | 30.05 | 4.10 | 0.02 | 0.053 | 0.02 | 0.015 |
| 12 | 0.006 | 0.005 | 5.93 | 30.00 | 3.30 | 0.21 | 0.11 | 0.001 | 0.008 |
| 13 | 0.008 | 0.006 | 6.18 | 30.05 | 3.33 | 0.020 | 0.11 | 0.001 | 0.019 |
| 14 | 0.010 | 0.004 | 5.89 | 30.15 | 3.19 | 0.48 | 0.11 | 0.001 | 0.017 |
| 15 | 0.008 | 0.004 | 5.62 | 30.18 | 3.35 | 0.51 | 0.12 | 0.001 | — |
| 16 | 0.012 | 0.003 | 5.45 | 30.19 | 3.37 | 0.51 | 0.10 | 0.001 | 0.0005 |

*Nitrogen, not cerium.

TABLE II

| Alloy | Sulfidation Resistance Mass Gain at 1500° F. (815° C.) ($Mg/cm^2$) | Time, hrs. |
|---|---|---|
| 60Ni—30Cr—10Fe | 101.0 | 48 |
| G | 11.9 | 528 |
| 1 | 45.5 | 408 |
| 2 | 6.6 | 528 |
| 3 | 2.3 | 2232 |
| H | 78.6 | 24 |
| 4 | 8.5 | 1200 |
| 5 | −13.7 | 1200 |
| 6 | 1.4 | 1200 |
| 7 | 1.3 | 1200 |
| 8 | 8.9 | 1200 |
| 9 | 2.8 | 1200 |
| I | 29.0 | 24 |
| 10 | 54.5 | 54 |
| 11 | 0.4 | 1008 |
| 12 | 0.3 | 840 |
| 13 | 1.6 | 840 |

TABLE II-continued

| | | | |
|---|---|---|---|
| 14 | 0.6 | 840 | |
| 15 | 0.3 | 840 | |
| 16 | 0.7 | 840 | |

24 Hour Cyclic Oxidation Resistance

| Alloy | 830° F. (mg/cm²) | Undescaled Mass Change (1000° C.) Time (h) | 2010° F. (mg/cm²) | (1100° C.) Time (h) | 2200° F. (mg/cm²) | (1205° C.) Time (h) |
|---|---|---|---|---|---|---|
| 60-30-10 | 0.3 | 264 | −10.3 | 500 | — | — |
| G | −0.4 | 1008 | −1.5 | 1008 | — | — |
| 1 | −1.2 | 1008 | −0.1 | 1008 | — | — |
| 2 | −0.1 | 1008 | −0.1 | 1008 | — | — |
| 3 | −0.3 | 1008 | −0.2 | 1008 | — | — |
| H | 0.1 | 1008 | −2.0 | 1008 | — | — |
| 4 | 0.9 | 1008 | −6.5 | 1008 | — | — |
| 5 | 0.5 | 1008 | −7.6 | 1008 | — | — |
| 6 | −1.3 | 1008 | −2.9 | 1008 | — | — |
| 7 | −2.0 | 1008 | −4.3 | 1008 | — | — |
| 8 | −0.1 | 1008 | −10.4 | 1008 | — | — |
| 9 | −0.8 | 1008 | −6.3 | 1008 | — | — |
| I | 1.4 | 1032 | −5.7 | 1008 | −33.6 | 984 |
| 10 | 0.2 | 1032 | 0.7 | 1008 | 0.5 | 984 |
| 11 | 0.6 | 1032 | 0.7 | 1008 | −2.1 | 984 |
| 12 | −0.2 | 840 | −0.1 | 840 | — | — |
| 13 | +0.3 | 840 | −3.5 | 840 | — | — |
| 14 | −0.2 | 840 | −1.8 | 840 | — | — |
| 15 | −0.6 | 840 | −2.3 | 840 | — | — |
| 16 | −0.1 | 840 | +0.9 | 840 | — | — |

Carburization Resistance
Mass Gain at 1830° F. (1000° C.) in 1008h

| Alloy | $H_2$ - 1% CH (mg/cm²) | $H_2$ - 12% $CH_4$ - 10% $H_2O$ (mg/cm²) |
|---|---|---|
| 60-30-10 | 23.7 | 28.9 |
| G | 9.2 | 10.7 |
| 1 | 9.6 | 12.0 |
| 2 | 6.0 | 2.1 |
| 3 | 2.0 | 1.7 |
| H | 37.5 | 29.0 |
| 4 | 10.9 | 20.8 |
| 5 | 7.9 | 17.9 |
| 6 | 3.8 | 6.2 |
| 7 | 5.5 | 4.6 |
| 8 | 7.5 | 8.4 |
| 9 | 4.6 | 5.9 |
| I | 0.5 | 13.7 |
| 10 | 0.6 | 0.8 |
| 11 | 1.4 | 0.5 |
| 12 | 8.5 (at 792 hr.) | 5.1 (at 792 hr.) |
| 13 | 6.3 (at 792 hr.) | 6.9 (at 792 hr.) |
| 14 | 8.1 (at 792 hr.) | 4.5 (at 792 hr.) |
| 15 | 7.8 (at 792 hr.) | 8.2 (at 792 hr.) |
| 16 | 6.4 (at 792 hr.) | 7.4 (at 792 hr.) |

TABLE III

Stress Rupture Properties at 2 ksi/1800° F. (980° C.)

| Alloy | Condition | Stress (ksi) | Temp. (°F.) | Time to Rupture (h) |
|---|---|---|---|---|
| 60-30-10 | | | | |
| G | HR + An | 2.0 | 1800 | 329, 582 |
| G | HR + An + Age | 2.0 | 1800 | 1084 |
| 1 | HR + An | 2.0 | 1800 | 210, 276 |
| 1 | HR + An + Age | 2.0 | 1800 | 269 |
| 2 | HR + An | 2.0 | 1800 | 1330 |
| 3 | HR + An | 2.0 | 1800 | 938, 1089 |
| 4 | HR + An | 2.0 | 1800 | 192, 355 |
| I | HR + An + Age | 2.0 | 1800 | 1365*, 5636, 5664 |
| 10 | HR + An | 2.0 | 1800 | 302 |
| 10 | HR + An + Age | 2.0 | 1800 | 310, 320 |
| 11 | HR + An | 2.0 | 1800 | 1534* |
| 11 | HR + An + Age | 2.0 | 1800 | 1389* |

*Duplicate samples were increased to 4.5 ksi at time shown. Failure occurred within 0.1 h in all cases.
HR = hot rolled at 2050° F. (1120° C.)
An = annealed at 1000° F. (1040° C.)
Age = 1400° F. (700° C.)/500 hr/Air Cool

TABLE III-A

| Alloy Alloy | Conditions Conditions | Stress, (KSI) | Temp., °F. | Time to Rupture hr. | Elong., % |
|---|---|---|---|---|---|
| 4 | HR + An(1) | — | — | — | — |
| | HR + An(2) | 4 | 1800 | 41.7 | 27.3 |
| | HR + An(1) | 2 | 2000 | 16.0 | 64.1 |
| | HR + An(2) | 2 | 2000 | 14.5 | 64.7 |
| 5 | HR + An(1) | 4 | 1800 | 12.7 | 33.6 |
| | HR + An(2) | 4 | 1800 | 61.9 | 16.7 |
| | HR + An(1) | 2 | 2000 | | X |
| | HR + An(2) | 2 | 2000 | | X |
| 7 | HR + An(1) | 4 | 1800 | 6.5 | 12.3 |
| | HR + An(2) | 4 | 1800 | 66.6 | 62.6 |
| | HR + An(1) | 2 | 2000 | 12.7 | * |
| | HR + An(2) | 2 | 2000 | * | * |
| 8 | HR + An(1) | 4 | 1800 | 11.9 | 70.6 |
| | HR + An(2) | 4 | 1800 | 102.4 | 59.9 |
| | HR + An(1) | 2 | 2000 | 20.2 | 64.0 |
| | HR + An(2) | 2 | 2000 | 18.5 | 82.5 |
| 9 | HR + An(1) | 4 | 1800 | 17.9 | 75.3 |
| | HR + An(2) | 4 | 1800 | 38.7 | 34.3 |
| | HR + An(1) | 2 | 2000 | 18.3 | 137.2 |

TABLE III-A-continued

| Alloy Alloy | Conditions Conditions | Stress, (KSI) | Temp., °F. | Time to Rupture hr. | Elong., % |
|---|---|---|---|---|---|
| | HR + An(2) | 2 | 2000 | 34.7 | 38.0 |

An(1) = 1900° F./1 hr/Air Cool
An(2) = 2150° F./1 hr/Air Cool

TABLE IV

| Alloy | Tensile Properties Room Temperature Tensile Data Y.S. (ksi) | T.S. (ksi) | Elong (%) | R.A. (%) | Hardness ($R_c$) |
|---|---|---|---|---|---|
| | Hot Rolled at 2050° F. (1120° C.) | | | | |
| G | 122.0 | 144.0 | 31.0 | — | 27 |
| 1 | 117.0 | 142.0 | 31.0 | — | 30 |
| 2 | 122.0 | 155.0 | 29.0 | — | 28 |
| 3 | 151.0 | 179.0 | 24.0 | — | 34 |
| H | 90.0 | 118.0 | 31.0 | — | 99 $R_b$ |
| I | 116.6 | 145.0 | 20.0 | 39.0 | 27 |
| 10 | 131.7 | 165.8 | 27.0 | 62.0 | 30.5 |
| 11 | 131.8 | 171.7 | 21.0 | 35.0 | 33.5 |
| | Hot Rolled at 2050° F. (1120° C.) Plus Anneal [1900° F. (1040° C.)/1 h/AC] | | | | |
| G | 46.0 | 103.0 | 60.0 | — | 78 |
| 1 | 60.0 | 115.0 | 56.0 | — | 89 |
| 2 | 68.0 | 126.0 | 47.0 | — | 96 |
| 3 | 96.0 | 157.0 | 38.0 | — | 29 $R_c$ |
| H | 35.0 | 93.0 | 53.0 | — | 78 |
| I | 50.1 | 107.2 | 50.0 | 52.0 | 85 |
| 10 | 71.8 | 127.6 | 48.0 | 61.0 | 94 |
| 11 | 80.9 | 126.3 | 45.0 | 58.0 | 97.5 |
| | Hot Rolled at 2050° F. (1120° C.) Plus Anneal [1900° F. (1040° C.)/1 h/AC] Plus Age [1400° F. (760° C.)/500 h/AC] | | | | |
| G | 70.0 | 131.0 | 37.0 | — | 97 |
| 1 | 77.0 | 141.0 | 34.0 | — | 99 |
| 2 | 85.0 | 144.0 | 35.0 | — | 23 $R_c$ |
| 3 | 109.0 | 168.0 | 26.0 | — | 32 $R_c$ |
| H | 34.0 | 92.0 | 54.0 | — | 75 |
| I | 57.5 | 119.4 | 41.0 | 56.0 | 94 |
| 10 | 74.8 | 141.9 | 33.0 | 44.0 | 99.5 |
| 11 | 119.8 | 178.3 | 19.2 | 32.0 | 24.5 $R_c$ |

The data in Table II and FIGS. 1–5 are illustrative of the improvement in sulfidation and oxidation resistance characteristic of the alloy composition within the invention, particularly in respect of those compositions containing over 3% aluminum and over 0.75% columbium.

Turning to FIG. 1, the low alumimum alloys (less than ½%) A-F reflect that their oxidation characteristics would not significantly extend the life of the 60-Ni-30Cr-10Fe alloy for the vitrification application given a failure mechanism due to oxidation. Cerium and cerium plus columbium did, however, impove this characteristic.

Similarly, FIGS. 2 and 3 depict cyclic oxidation behavior at 1100° C. (2012° F.) and 1200° C. (2192° F.) of Alloy I versus Alloys 10 and 11. The low aluminum, high iron Alloy I fared rather poorly. The oxidation resistance of both Alloys 10 and 11 was much superior after 250 days than was Alloy I after, say, 50 days.

With regard to FIGS. 4 and 5 and Table II, it will be noted that sulfidation resistance of the compositions within the invention was quite superior to the control alloy and Alloys beyond the scope of the invention. Alloys 3–9 were particularly effective (low iron, 3%+aluminum and 1%+aluminum). Alloy 5 based on all the test data should have given a better result beyond the 40 day test period though it was many times superior to the 60-NI-30-Cr-10Fe control. (As in most experimental work involving corrosion testing and as the artisan will understand, there is usually, if not always, at least one (or more) alloy specimen which, often unexplainably, behaves differently from the others, in this case a composition such as Alloy 10. It is being reexamined).

With regard to the stress-rupture results depicted in Table III, it will be observed that all the compositions within the invention exceeded the desired minimum stress rupture life of 200 hours at the 1800° F. (980° C.) temperature/2000 psi test condition, this in the annealed as well as the aged condition. The 60Ni-30Cr-10Fe control failed to achieve the 200-hour level in the annealed condition. Referring to Table III-A and using Alloy 8 as a comparison base (approximately 30% Cr, 3% Al, less than 5% Fe and 1% Cb) is can be seen that the other alloys did not reach a combined stress-rupture life of circa 100 hours and a ductility of 60% with the aid of a higher annealing temperature. The rupture life of Alloy b 5, for example, was improved with the 2150° F. anneal but ductility markedly dropped. It is deemed that the high chromium content contributed to this. The higher columbium of Alloy 9 is considered to have had a similar effect. As previously stated, it is with advantage that the chromium and columbium should not exceed 32% and 1.5%, respectively.

Concerning the tensile properties reported in Table IV all the alloys within the invention, i.e., Alloys 1–4 and 11–13, compared more than favorably with Alloy H an alloy similar to 60Ni-30Cr-10Fe, irrespective of the processing employed, i.e., whether in the hot rolled or annealed or aged condition. It is worthy of note that Alloys I and 11 were also tested for their ability to absorb impact energy (toughness) using the standard Charpy V-Notch impact test. These alloys were tested at room temperature in the given annealed condition and the average (duplicate specimens) for Alloys I and 11 was 99 ft. lbs. and 69.5 ft. lbs., respectively. In the aged condition Alloy 11 exhibited a toughness of but 4.5 ft. lbs. This is deemed to result from the higher aluminum content. In the aged condition Alloy I had 79 ft. lb. impact energy level.

While the present invention has been described with reference to specific embodiments, it is to be understood that modifications and variations may be resorted to without departing from the spirit and scope of the invention, as those skilled in the art will readily understand. Such modifications and variations are considered to be within the purview and scope of the invention and appended claims. A given percentage range for an element can be used with a given range for for the other constituents. The term "balance" or balance "essentially" used in referring to the nickel content of the alloy does not exclude the presence of other elements in amounts which do not adversely affect the basic characteristics of the invention alloy. It is considered that, in addition to the wrought form, the invention alloy can be used in the cast condition and powder metallurgical processing can be utilized.

The embodiments of the invention in which an exclusive property or privilege is claimed are defined as follows:

1. A nickel-base, high chromium alloy characterized by excellent resistance to (1) sulfidation and (ii) oxidation at elevated temperatures as high as 2000° F. (1093° C.) and higher, (iii) a stress-rupture life of about 200 hours or more at a temperature at least as high as 1800° F. (983° C.) and under a stress of 2000 psi, (iv) good tensile strength and (v) good ductility both at room and elevated temperature, said alloy consisting essentially of about 27 to 35% chromium, about 2.5 to 5% aluminum, about 2.5 to about 6% iron, 0.5 to 2.5% columbium, up to 0.1% carbon, up to 1% each of titanium and zirconium, up to 0.05% cerium, up to 0.05% yttrium, up to 1% silicon, up to 1% manganese, and the balance nickel.

2. The alloy of claim 1 containing 27 to 32% chromium, from 2.75 to about 4% aluminum, from 2.75 to about 5% iron, and up to 0.04% carbon.

3. The alloy of claim 2 containing about 0.75 to 1.5% columbium.

4. The alloy of claim 1 containing about 0.005 to 0.015% cerium.

5. The alloy of claim 3 containing about 0.005 to 0.015% cerium.

6. The alloy of claim 1 in which at least one member of titanium and zirconium is present in an amount up to 0.5%.

7. The alloy of claim 1 in which manganese is present up to not more than 0.5%.

8. The alloy of claim 7 in which silicon does not exceed 0.5%.

9. The alloy of claim 1 in which nitrogen is present up to 0.05%.

10. The alloy of claim 3 in which nitrogen is present up to 0.04%.

11. A nickel-base, high chromium alloy characterized by good sulfidation and oxidation resistance together with a good stress rupture life and ductility at elevated temperature and room temperatures tensile and ductility properties, said alloy consisting essentially of 25 to 35% chromium, 2 to 5% aluminum, about 2.5 to 6% iron, up to 2.5% columbium, up to 0.1% carbon, up to 1% of titanium, up to 1% zirconium nitrogen present in a beneficial amount up to about 0.05%, up to 0.05% cerium up to 0.05% yttrium, up to 1% silicon, up to 1% manganese, up to about 0.05% nitrogen and the balance nickel.

12. The alloy of claim 11 containing 2.5 to 4% aluminum, 2.5–5.5% iron, 0.75 to 1.5% columbium, up to 0.05% carbon, up to 0.012% cerium, up to 0.5% titanium and up to 0.5% zirconium.

* * * * *